US009028085B2

(12) United States Patent
Todd, Jr.

(10) Patent No.: US 9,028,085 B2
(45) Date of Patent: May 12, 2015

(54) LIGHTING AND HEATING ASSEMBLY FOR CEILING FAN

(71) Applicant: Alvin E. Todd, Jr., Pigeon Forge, TN (US)

(72) Inventor: Alvin E. Todd, Jr., Pigeon Forge, TN (US)

(73) Assignee: Alvin E. Todd, Pigeon Forge, TN (US)

( * ) Notice: Subject to any disclaimer, the term of this patent is extended or adjusted under 35 U.S.C. 154(b) by 160 days.

(21) Appl. No.: 13/713,763

(22) Filed: Dec. 13, 2012

(65) Prior Publication Data

US 2013/0101416 A1 Apr. 25, 2013

Related U.S. Application Data

(63) Continuation-in-part of application No. 12/862,417, filed on Aug. 24, 2010, which is a continuation-in-part of application No. 11/935,855, filed on Nov. 6, 2007, now abandoned.

(51) Int. Cl.

| | |
|---|---|
| ***F21V 33/00*** | (2006.01) |
| ***F04D 29/00*** | (2006.01) |
| ***F04D 25/08*** | (2006.01) |
| ***F04D 29/58*** | (2006.01) |

(52) U.S. Cl.

CPC ..... *F04D 29/00* (2013.01); *F04D 25/088* (2013.01); *F04D 29/582* (2013.01); *F04D 29/584* (2013.01); *F21V 33/0096* (2013.01)

(58) Field of Classification Search

CPC ..... F04F 25/088; F04D 29/00; F04D 29/582; F04D 29/584; F21V 33/0096

USPC ..... 416/5, 95

See application file for complete search history.

(56) References Cited

U.S. PATENT DOCUMENTS

| | | | |
|---|---|---|---|
| 332,821 | A | 12/1885 | Murray, Jr. et al. |
| 1,226,734 | A | 5/1917 | Work |
| 1,383,564 | A | 7/1921 | Phillipson |
| 1,388,822 | A | 8/1921 | Roys |
| 1,389,235 | A | 8/1921 | Zieley |
| 1,399,931 | A | 12/1921 | Clutts |
| 1,472,124 | A | 10/1923 | Howe et al. |
| 1,499,894 | A | 7/1924 | Waterman |
| 1,687,544 | A | 10/1928 | Clark et al. |
| 1,723,405 | A | 8/1929 | Carmean |
| 1,813,023 | A | 7/1931 | Cheslock et al. |
| 2,262,898 | A | 11/1941 | MacGregor |
| 2,274,935 | A | 3/1942 | Naul |
| 2,411,782 | A | 11/1946 | Gardes |
| 2,619,578 | A | 11/1952 | Jepson et al. |
| 3,296,738 | A | 1/1967 | Wiegel |
| 4,064,427 | A | 12/1977 | Hansen et al. |
| 4,428,032 | A | 1/1984 | Workman |
| 4,455,449 | A | 6/1984 | Rendel |
| 4,504,191 | A | 3/1985 | Brown |
| 4,508,958 | A | 4/1985 | Kan et al. |

(Continued)

*Primary Examiner* — Sharon Payne

(74) *Attorney, Agent, or Firm* — Pitts & Lake, P.C.

(57) ABSTRACT

A lighting assembly for a ceiling fan, the ceiling fan having an attachment interface having an electrical connection for powering an external assembly, the lighting assembly including a housing configured to be connected to and supported by the attachment interface of the ceiling fan, a plurality of lighting arms extending from the housing and provided with a socket to receive a light bulb, the socket being configured to be in electrical communication with the electrical connection of the ceiling fan, and an auxiliary connection provided at a side of the housing to provide power to an external device coupled to the housing.

17 Claims, 13 Drawing Sheets

(56) References Cited

U.S. PATENT DOCUMENTS

| | | | | | |
|---|---|---|---|---|---|
| 4,531,179 | A | * | 7/1985 | Baker | 362/371 |
| 4,657,485 | A | | 4/1987 | Hartwig | |
| 4,782,213 | A | | 11/1988 | Teal | |
| 5,051,561 | A | * | 9/1991 | McWilliams et al. | 219/461.1 |
| 5,056,287 | A | * | 10/1991 | Weber | 52/511 |
| 5,077,825 | A | | 12/1991 | Monrose | |
| 5,193,984 | A | * | 3/1993 | Lin | 416/247 R |
| 5,224,830 | A | | 7/1993 | Wang | |
| 5,292,228 | A | | 3/1994 | Dye | |
| 5,333,235 | A | * | 7/1994 | Ryder | 392/364 |
| 5,349,513 | A | | 9/1994 | Taylor, III | |
| 5,404,284 | A | | 4/1995 | Davis, Jr. | |
| 5,440,459 | A | | 8/1995 | Chan | |
| 5,454,692 | A | | 10/1995 | Davis | |
| 5,528,469 | A | | 6/1996 | Todd, Jr. | |
| 5,545,009 | A | | 8/1996 | Ke | |
| D381,074 | S | | 7/1997 | Pelonis | |
| 5,668,920 | A | | 9/1997 | Pelonis | |
| 5,672,002 | A | | 9/1997 | Todd, Jr. | |
| 5,687,068 | A | | 11/1997 | Jamieson et al. | |
| 5,738,496 | A | * | 4/1998 | Mehta | 417/44.1 |
| 5,800,049 | A | | 9/1998 | Todd, Jr. | |
| 5,847,636 | A | | 12/1998 | Sehlhorst | |
| 5,877,670 | A | | 3/1999 | Sehlhorst et al. | |
| 6,019,577 | A | | 2/2000 | Dye | |
| 6,062,816 | A | | 5/2000 | Chang | |
| 6,086,226 | A | | 7/2000 | Chang | |
| 6,089,725 | A | * | 7/2000 | Chen | 362/96 |
| 6,089,726 | A | * | 7/2000 | Eldridge, Jr. | 362/96 |
| 6,160,956 | A | | 12/2000 | Pelonis | |
| 6,213,617 | B1 | | 4/2001 | Barker | |
| 6,224,226 | B1 | | 5/2001 | Bucher et al. | |
| 6,240,247 | B1 | | 5/2001 | Reiker | |
| 6,244,820 | B1 | | 6/2001 | Yilmaz | |
| 6,322,232 | B1 | | 11/2001 | Oliver | |
| 6,366,733 | B1 | | 4/2002 | Reiker | |
| 6,438,322 | B1 | | 8/2002 | Reiker | |
| 6,517,223 | B2 | * | 2/2003 | Hsu | 362/405 |
| 6,631,243 | B2 | | 10/2003 | Reiker | |
| 6,676,375 | B2 | | 1/2004 | Steeves LeBlanc et al. | |
| 6,682,303 | B2 | | 1/2004 | Wu | |
| 6,751,406 | B2 | | 6/2004 | Reiker | |
| 6,764,204 | B1 | * | 7/2004 | Peters | 362/429 |
| 7,318,701 | B2 | | 1/2008 | Farmer | |
| 7,931,388 | B2 | * | 4/2011 | Kanpurwala et al. | 362/249.03 |
| 8,107,797 | B2 | | 1/2012 | Abodreham et al. | |
| 2002/0021891 | A1 | | 2/2002 | Reiker | |
| 2002/0064380 | A1 | | 5/2002 | Reiker | |
| 2002/0081107 | A1 | | 6/2002 | Reiker | |
| 2003/0223869 | A1 | | 12/2003 | Wu | |
| 2003/0228142 | A1 | | 12/2003 | Reiker | |
| 2004/0247440 | A1 | | 12/2004 | Boubin | |
| 2005/0265034 | A1 | * | 12/2005 | Yen | 362/405 |
| 2006/0078460 | A1 | | 4/2006 | Ryu et al. | |
| 2006/0209532 | A1 | | 9/2006 | Hardgrave | |
| 2006/0285310 | A1 | | 12/2006 | Shyu | |
| 2010/0316495 | A1 | | 12/2010 | Todd, Jr. | |

* cited by examiner

LIGHTING AND HEATING ASSEMBLY FOR CEILING FAN

CROSS-REFERENCE TO RELATED APPLICATIONS

This application is a Continuation-In-Part of U.S. application Ser. No. 12/862,417, filed Aug. 24, 2010, which is a Continuation-In-Part of U.S. application Ser. No. 11/935,855, filed Nov. 6, 2007.

STATEMENT REGARDING FEDERALLY-SPONSORED RESEARCH OR DEVELOPMENT

Not Applicable

BACKGROUND OF THE INVENTION

1. Field of Invention

The present invention relates to ceiling fans. More particularly, this invention relates to an external assembly for a ceiling fan.

2. Description of the Related Art

Typically ceiling fans have been used to circulate air within a warm environment. For a given environment, it is well known that warmer air generally occupies the area adjacent to the top of the environment and the cooler air generally occupies the area adjacent to the bottom of the environment. The air circulated by the ceiling fan essentially distributes the warmer air and cooler air within the environment such that a person experiences a cooling effect due to the air movement. Thus, typical ceiling fans only circulate air within the environment to create a cooling effect.

Accordingly, use of ceiling fans is generally limited to warm environments because they do not alter the temperature of the air being circulated. Cold environments are an exemplary example where ceiling fans are largely ineffective due to the cooling effect caused by the circulation of air within the environment.

BRIEF SUMMARY OF THE INVENTION

A lighting and heating assembly for a ceiling fan is described in herein and illustrated in the accompanying figures. The lighting and heating assembly is configured for use with an existing ceiling fan that is mounted to a ceiling and includes a plurality of rotatable fan blades, which circulate air within an environment. The ceiling fan also includes an attachment interface and an electrical connection for securing and providing external assemblies.

The lighting and heating assembly includes two main components, namely a lighting assembly and a heating assembly. The lighting and heating assembly includes a lighting assembly for distributing light and a heating assembly for providing heat to the air circulated by the ceiling fan. The lighting assembly is attachable to the ceiling fan and the heating assembly detachably connected to the lighting assembly, which allows the lighting assembly to be used without the heating assembly.

Additionally, the lighting and heating assembly is adjustable such that the lighting assembly and/or heating assembly are repositionable at desired locations in relation to one another and the air flow generated by the ceiling fan. Specifically, the lighting assembly includes a plurality of telescoping arms that extend outwardly and carry a socket in electrical communication with the electrical connection such that a light bulb provides adjustable lighting for an environment. The heating assembly includes a heating element supported by a thermally isolated heating element cage that provides protection from thermal injuries typically received from contact with an energized heating element.

Furthermore, the lighting and heating assembly provides a plurality of light bulb shields. Generally, the light bulb shields are aesthetically pleasing and are arranged such that unsightly low wattage light bulbs are removed from significant view. Alternatively, the light bulb shields may be configured to provide protection for the light bulbs such that the light bulb is not affected by heat generated by the heating assembly.

Various aspects of the present general inventive concept may be achieved by a lighting assembly for a ceiling fan, the ceiling fan having an attachment interface having an electrical connection for powering an external assembly, the lighting assembly including a housing configured to be connected to and supported by the attachment interface of the ceiling fan, a plurality of lighting arms extending from the housing and provided with a socket to receive a light bulb, the socket being configured to be in electrical communication with the electrical connection of the ceiling fan, and an auxiliary connection provided at a side of the housing to provide power to an external device coupled to the housing.

The auxiliary connection may be selectively connected to the electrical connection of the ceiling fan or a separate power source provided through the housing.

The lighting assembly may further include a heating assembly that is readily attachable and detachable to the auxiliary connection of the lighting assembly, wherein the structure and operation of the lighting assembly is maintained during the attachment and/or detachment of the heating assembly.

The heating assembly may include a heating element having at least one heating terminal that is selectively connected to the auxiliary connection of the lighting assembly.

The heating element may be provided around a portion of the lighting assembly.

The at least one heating terminal may include a flexible portion extending from the heating element.

The heating assembly may further include a heating element cage configured to be suspended from a structural point other than the housing of the lighting assembly to support the heating element.

The lighting assembly may further include an external power connection provided along a suspension portion of the heating element cage and at least one of the lighting arms, wherein the heating element may be selectively connected to the external power connection or the auxiliary connection of the housing.

The lighting assembly may further include an external power connection provided along a suspension portion of the heating element cage and at least one of the lighting arms to provide power to the auxiliary connection of the housing.

The external power connection may be provided inside the at least one lighting arm.

The height of the heating assembly may be adjustable to move the heating element closer to or further from ceiling fan.

The heating assembly may include a base that is configured to be coupled to a top portion of the housing, one or more support members extending downward and outward from the base, a heating element supported by the support members such that the heating element is provided around a portion of the housing and under blades of the ceiling fan, and a flexible heating terminal to connect to the auxiliary connection of the housing.

The plurality of lighting arms may be configured to be selectively extended from and retracted to various distances from the housing.

The lighting assembly may further include partitioning members provided inside the housing to prevent respective wirings of the lighting arms from contacting one another.

The housing may be approximately bell shaped, and the broader end of the housing may be coupled to the ceiling fan.

The lighting assembly may further include an additional housing of substantially the same shape inverted and coupled between the housing and ceiling fan.

The additional housing may accommodate an additional plurality of lighting arms.

Other features and aspects may be apparent from the following detailed description, the drawings, and the claims.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A lighting and heating assembly for a ceiling fan is described in detail herein and illustrated in the accompanying figures. The lighting and heating assembly is configured for mounting to an existing ceiling fan. The lighting and heating assembly includes a lighting assembly for distributing light and a heating assembly for providing heat to the air circulated by the ceiling fan. The lighting assembly is configured to attach to the ceiling fan and has the heating assembly detachably connected thereto, which allows the lighting assembly to be used without the heating assembly. Additionally, the lighting and heating assembly is adjustable such that the lighting assembly and/or heating assembly are repositionable at desired locations in relation to one another and the air flow generated by the ceiling fan.

Figure 1:
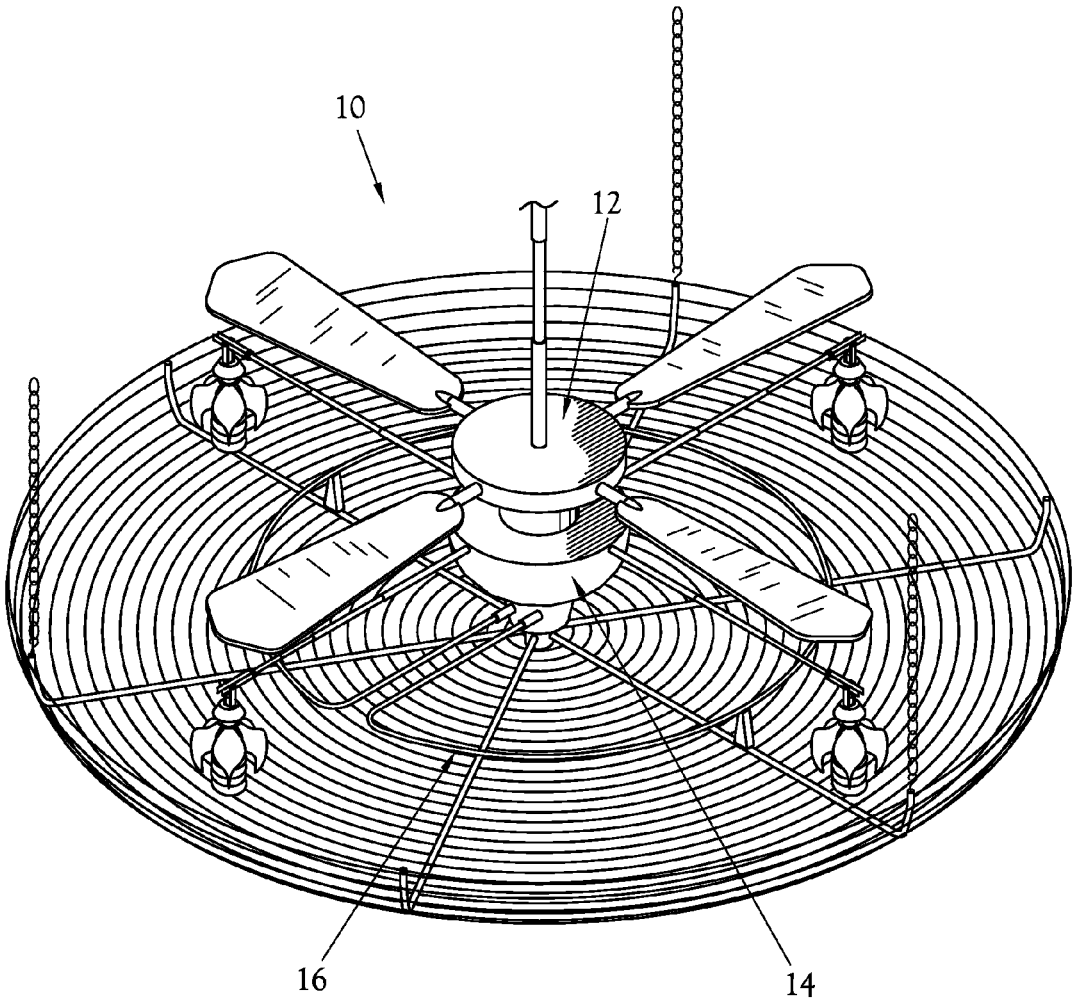
FIG. 1 is a perspective view of one embodiment of the present invention.

FIG. 1 illustrates one embodiment of a lighting and heating assembly 10 for a ceiling fan 12. As illustrated, the lighting and heating assembly 10 is attachable to the ceiling fan 12 and includes two main components, namely a lighting assembly 14 and a heating assembly 16.

Figure 2:
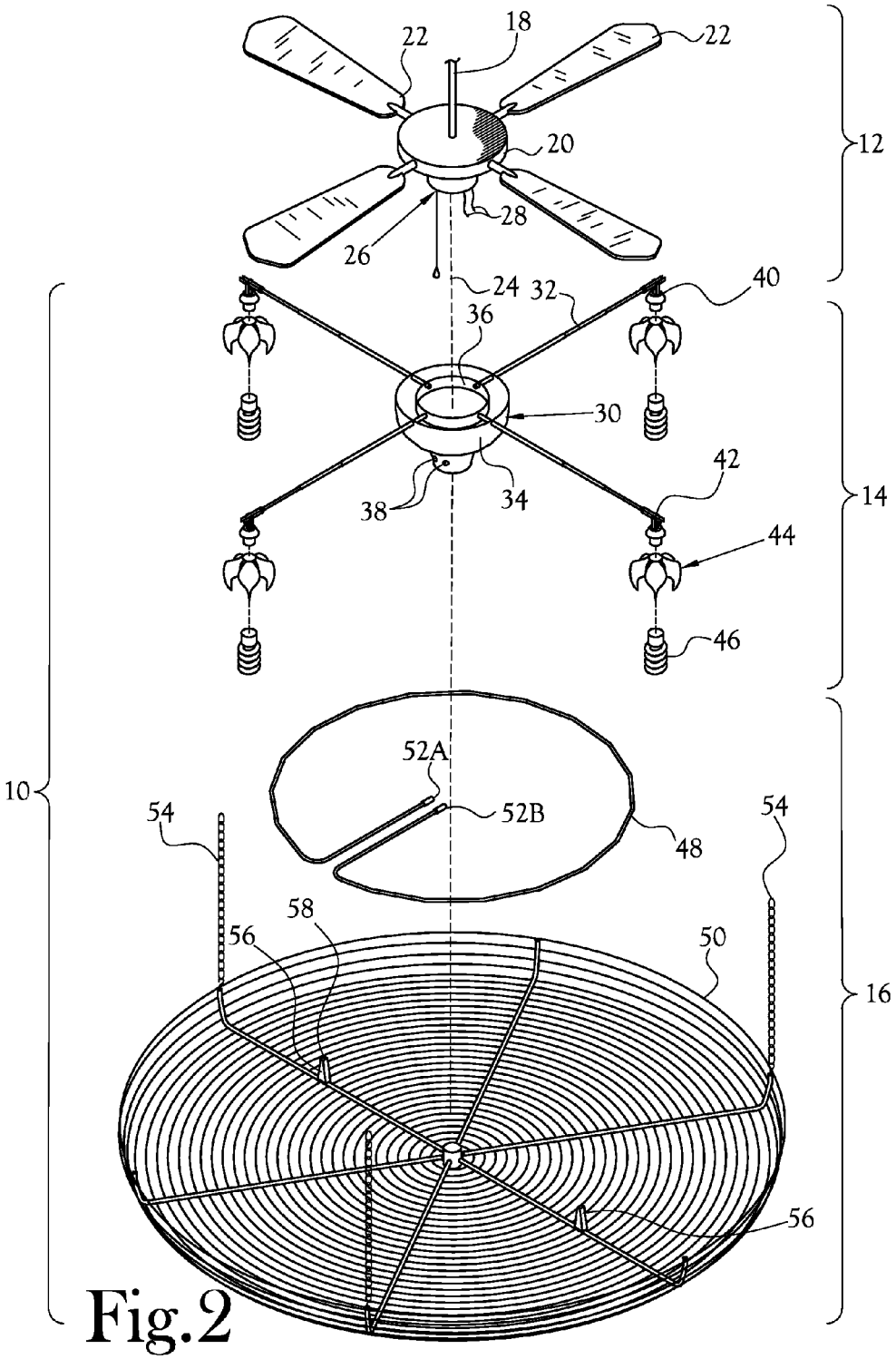
FIG. 2 is an exploded view of the embodiment of the present invention depicted in FIG. 1.

FIG. 2 illustrates an exploded view of the embodiment of the lighting and heating assembly 10 and the ceiling fan 12 depicted in FIG. 1. The lighting and heating assembly 10 is attachable to a ceiling fan 12, which is mounted to a ceiling, or other structural support, and provides circulation for an environment. In the depicted embodiment, the ceiling fan 12 is suspended by tubing 18, such as a downrod, that allows the ceiling fan 12 to be mounted to variable height structures, e.g., standard and lofted ceilings. The tubing 18 also provides a conduit through which wiring extends from the ceiling to the ceiling fan 12 for providing power. The ceiling fan 12 includes a fan housing 20 that encloses a conventional fan motor (not shown) having a plurality of fan blades 22. The fan blades 22 being arranged to generate air circulation. For example, in FIG. 2, the fan blades 22 are fabricated of wood, or other suitable material, in an oblong shape, in which two elongated sides are substantially parallel, one end defining a semicircle, and the other end having a decorative curve that forms a point, or shape with dimensions that are effective for creating air circulation. The fan blades 22 extend outward at equally spaced intervals around a vertical axis 24, as depicted in FIG. 2, defined by the ceiling fan 12. A rigid arm mounts the semicircle end of the fan blade 22 to a conventional fan motor at a desired angle such that, upon rotation of the fan blades 22, air is circulated. Furthermore, the bottom of the fan housing 20 provides an attachment interface 26 for securing external assemblies to the ceiling fan 12 and an electrical connection 28 for providing power to an external assembly. The fan housing 20 also provides controls, as depicted by pull-chains in FIG. 2, for the operation of the ceiling fan 12, and any attached external assembly. Alternatively, fan controls may be provided through wall-mounted or radio frequency devices.

The lighting assembly 14, illustrated in FIG. 2, includes a housing 30 and one or more lighting arms 32. The housing 30 is attachable to the ceiling fan 12 and encloses electrical components of the lighting assembly 14. In the illustrated embodiment, the lighting assembly 14 is secured to the attachment interface 26 of the ceiling fan 12 by fasteners, for example bolts. The light assembly housing 30 includes a casing 34, which encloses a frame 36 configured to support a plurality of lighting arms 32. As an example, in the illustrated embodiment, the casing 34 has an inverted bell shape, with a larger diameter at the top that tapers to a smaller diameter at the bottom. The casing 34 is open at the top such that the casing 34 receives a portion of the ceiling fan housing 20 when attached to the ceiling fan 12. Additionally, the lighting assembly housing 30 further includes an auxiliary connection 38 for attachment of the heating assembly 16 wherein the auxiliary connection 38 is in electrical communication with the electrical connection 38 provided by the ceiling fan 12.

The plurality of lighting arms 32 provides rigid support for the lighting. Generally, each of the lighting arms 32 is hollow such that electrical components are hidden. In FIG. 2, the plurality of lighting arms 32 are each fabricated from long, hollow, and cylindrically shaped tubing. Furthermore, in the illustrated embodiment, the lighting arms 32 are telescoping for allowing a desired amount of outward extension from the casing 34. For example, the length of the lighting arms 32 can extend outward farther from the vertical axis 24 than the rest of the lighting and heating assembly 10 such that the distribution of lighting is not effected.

The lighting arms 32 carry a light bulb socket 40 at the outboard end of each lighting arm 36. In one embodiment, a pivotal joint 42 is provided for each lighting arm 32 to allow adjustable orientation of the light bulb socket 40. For example, in the illustrated embodiment, the end of a lighting arm 32 includes a hinged connector for supporting a light bulb socket 40 and allowing the light bulb socket 40 to be pivoted in a desired direction. As depicted, the hinged connector is pivoted into a vertical orientation relative to the ground. In another embodiment, the hinged connector allows the light bulb socket 40 to pivot approximately 180 degrees along a vertical or horizontal axis. The lighting arms 32 carry a light bulb socket at the outboard end of each lighting arm 32 to rotate 360 degrees. FIG. 2 further depicts light bulbs shields 44, which are subsequently discussed in detail, being carried by each light bulb 46.

The lighting assembly 14 is powered by the ceiling fan 12 or other suitable power source. In the illustrated embodiment, the lighting assembly 14 is in electrical communication with the electrical connection 28 of the attachment interface 26 such that a user controls the lighting assembly 14 through the controls for the ceiling fan 12. The power supplied to the electrical connection 28 transfers power through wiring in the lighting arms 32 to the bulb sockets 40. In the illustrated embodiment, the light bulbs 46 secured to the light bulb sockets 40 are controlled by a switch or controller, such as a pull-chain.

The heating assembly 16 is supported by the ceiling fan and, more specifically, detachably mounted to the lighting assembly 14. The heating assembly 16 includes a heating element 48 and a heating element cage 50. The heating element 48 is generally positioned in communication with air flow produced by the ceiling fan 12. In the illustrated embodiments, the heating element 48 is positioned in a substantially horizontal plane, which is approximately parallel to the plane of the fan blades 22, allowing for direct exposure of the heating element 48 to the air flow generated by the ceiling fan 12. The heating assembly 16 is powered by a power supply which provides an effective amount of power for the heating element 48 to produce heat. In the illustrated embodiments, the heating element 48 has two terminals, namely a first terminal 52A and a second terminal 52B, which connect the heating element 48 in electrical communication with the auxiliary connection 38 of the lighting assembly 14. Additionally, the terminals 52A and 52B are readily detachable from the auxiliary connection 38 such that the heating assembly 16 is detachable from the lighting assembly 14.

The heating element cage 50 is permeable to air flow while providing support to the heating element 48 without significantly impeding the flow of air. In FIG. 2, the heating element cage 50 is disposed in a horizontal plane substantially parallel to the heating element 48 such that the heating element cage 50 provides support for the heating element 48 and restricts contact with the heating element 48. More specifically, the depicted heating element cage 50 comprises wire members formed into a configuration that provides large openings for air flow while producing an aesthetically pleasing design. It should also be noted that a large heating element cage 50 may require additional support for attachment to the lighting assembly 14 and ceiling fan 12. For example, in the illustrated embodiment, the heating element cage 50 is detachably connected to the ceiling by chains 54.

Additionally, in the illustrated embodiment, the heating element cage 50 supports the heating element 48 such that the heating element 48 is thermally isolated from the heating element cage 50 for providing protection from thermal injuries received from contact with an energized heating element 48. More specifically, the heating element cage 50 supports the heating element 48, in an elevated relationship to the heating element cage 50, by a plurality of heating element supports 56. The heating element supports 56 are disposed in spaced apart relationship to one another around the perimeter of the heating element 48. These heating element supports 56 are fixed to the cage 50 through welds or other suitable manner. In the illustrated embodiment, the heating element supports 56 are triangular-shaped and are situated with the base secured to the heating element cage 50 and the apex providing support for the heating element 48. More specifically, the depicted heating element supports 56 are ceramic insulators with semicircle indentations 58, which have an interior diameter substantially the same as the outer diameter of the heating element 48, at the apex of the triangle to support and mount the heating element 48 to the heating element cage 50. In alternate embodiments, the heating element supports 56 can be fabricated from another material suitable for insulating the cage 50 from heat produced by the heating element 48.

Figure 3A:
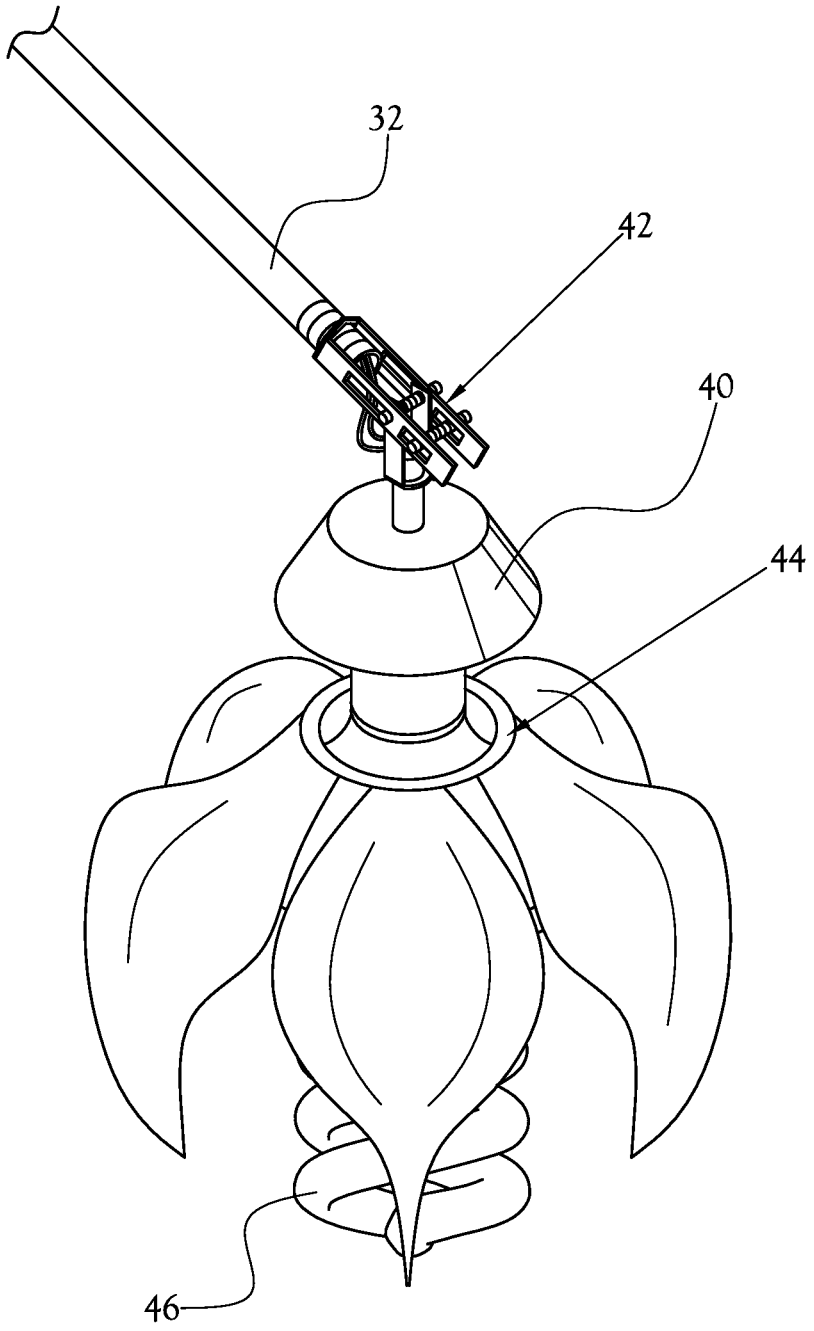
FIG. 3A is an enlargement of one embodiment of a light bulb shield having the front portion of shielding in hidden line to provide clarity of a low energy bulb shielded by the light bulb shield.
Figure 3B:
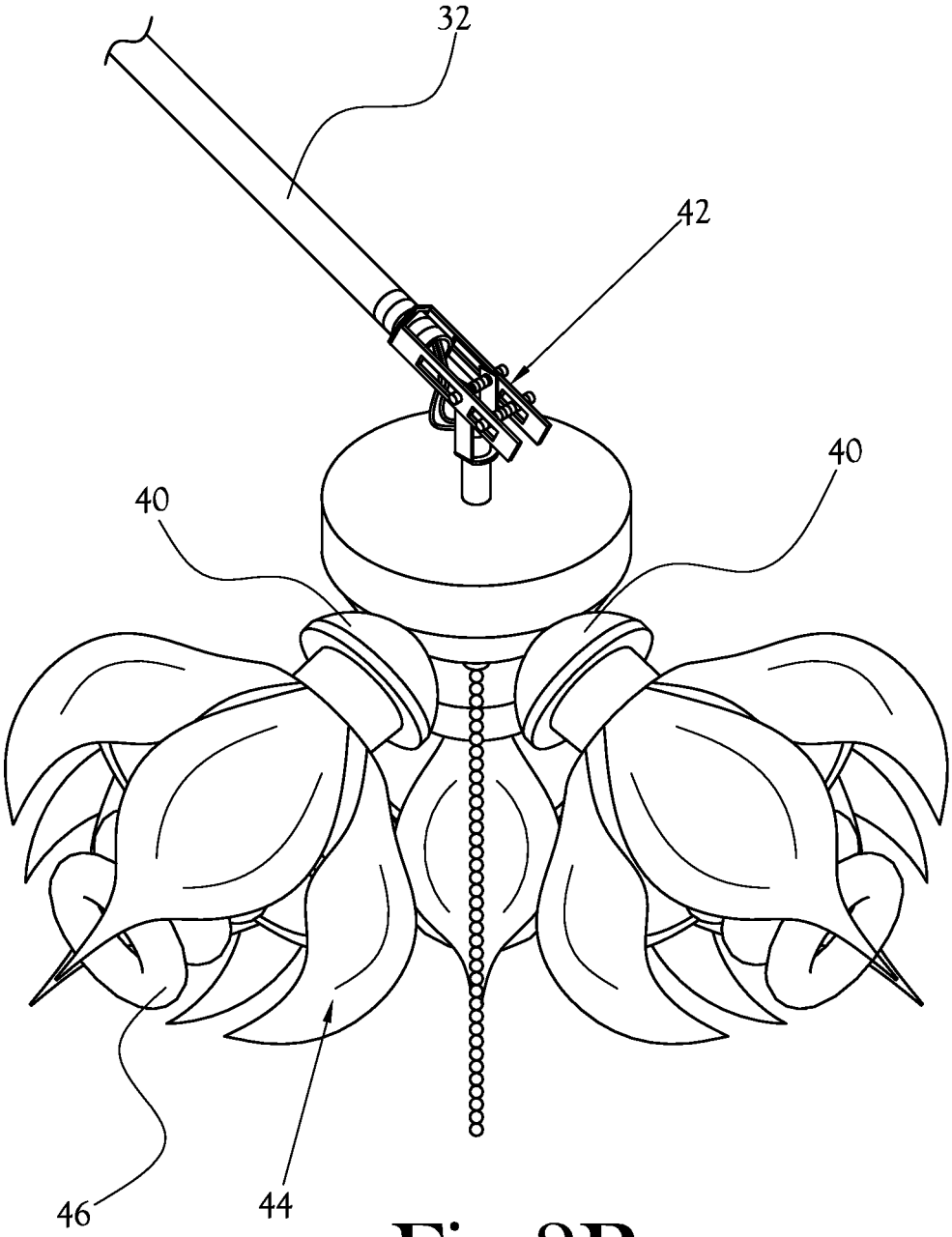
FIG. 3B is one embodiment of a cluster of light bulb shields and low energy bulbs.
Figure 3C:
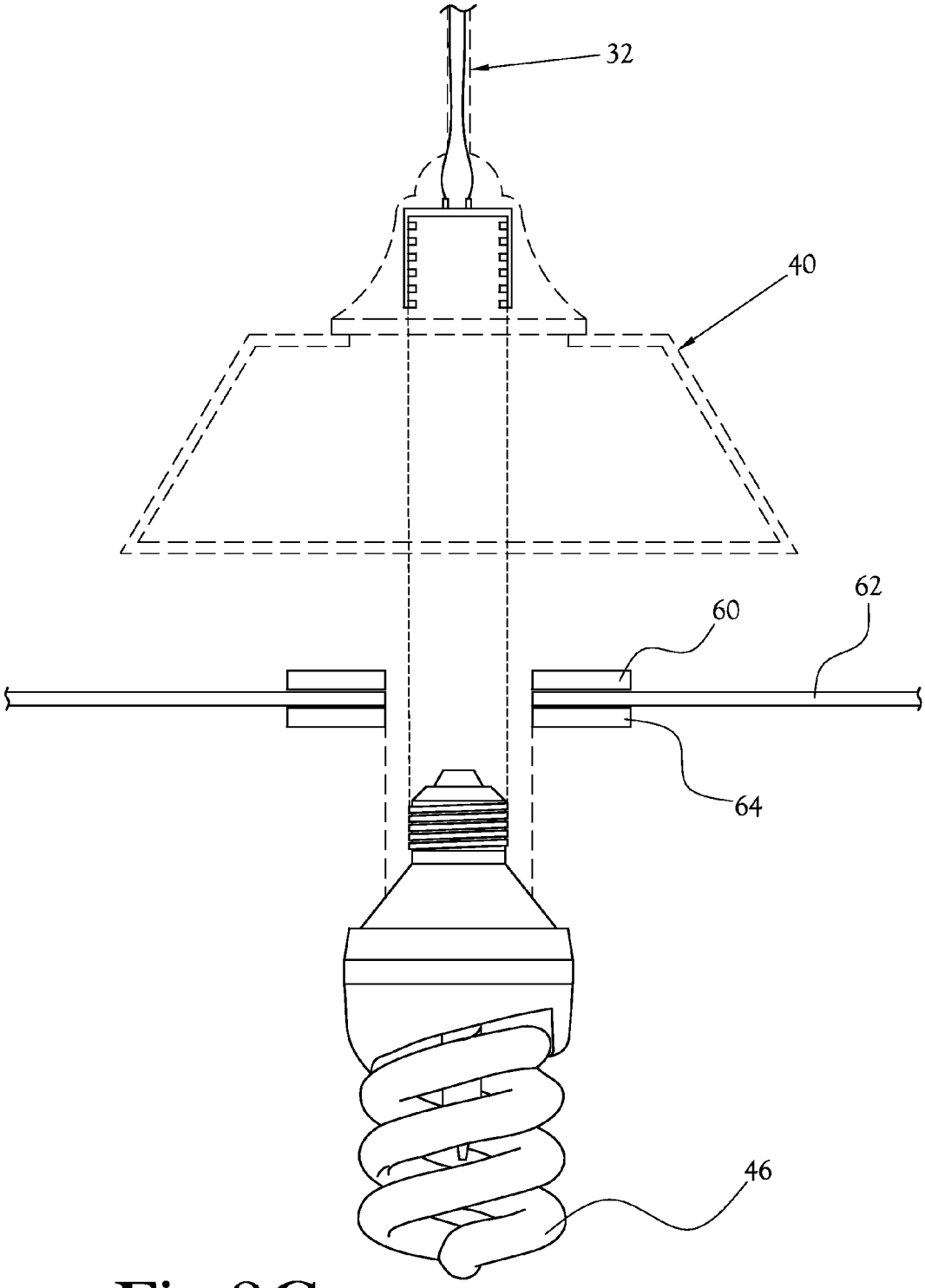
FIG. 3C is a sectional view of one embodiment of a light bulb shield in relation to the light bulb socket and a low energy bulb.

FIGS. 3A, 3B, and 3C illustrate embodiments of the light bulb shields 44 in greater detail. Each light bulb shield 44 is configured to be carried by a light bulb 46 such that at least a portion of the light bulb 46 is concealed. Generally, these light bulb shields 44 are arranged in an aesthetically pleasing design. For example, as shown in FIGS. 3A and 3B, the light bulb shields 44 include an aesthetically pleasing arrangement of leaves removing the unsightly low wattage light bulbs 44 from significant view. Alternatively, the light bulb shields 44 provide protection for the light bulbs 46 such that the light bulb 46 is not affected by heat generated by the heating assembly 16. For example, the light bulb shields 44, for use while utilizing the heating assembly 16, offer increased protection for the light bulbs 46. More specifically, the light bulb shields 44 are fabricated from material which is heat resistant and noncombustible, whereby heat generated by the heating assembly 16 will not affect the performance of the light bulb 46. Additionally, as depicted in FIG. 3B, a cluster of light bulb shields 44 and light bulbs 46 offer increased lighting for an environment.

Generally, these light bulb shields 44 are secured to the light bulbs 46 such that the light bulb shields 44 hang from the light bulbs 46. FIG. 3C illustrates one embodiment of the light bulb 46 and a sectional view of the light bulb shields 44 in relation to the bulb socket 40, depicted in hidden line. The bulb socket 40 is configured to receive the threaded end of a light bulb 46 such that the light bulb 46. More specifically, the light bulb shield 44 defines a central opening through which a narrow portion of the light bulb (e.g., the neck) passes and the wider portion of the light bulb 46 (e.g., the body) is restricted from passing. As a result, the light bulb shield 44 rests on the light bulb 46 when secured to the bulb socket 40. In the illustrated embodiment, the light bulb shield 44 includes an upper ring 60, shielding 62, and a lower ring 64. As depicted, the upper ring 60 and lower ring 64 cooperate together to receive and secure shielding 62 there between, for example in one embodiment the shielding 62 is glued to upper ring 60 and lower ring 64. In alternate embodiments, the light bulb shield 44 includes, but is not limited to, a single ring, a decorative ring, covering for the rings, or forming a ring with the shielding 62.

Figure 4A:
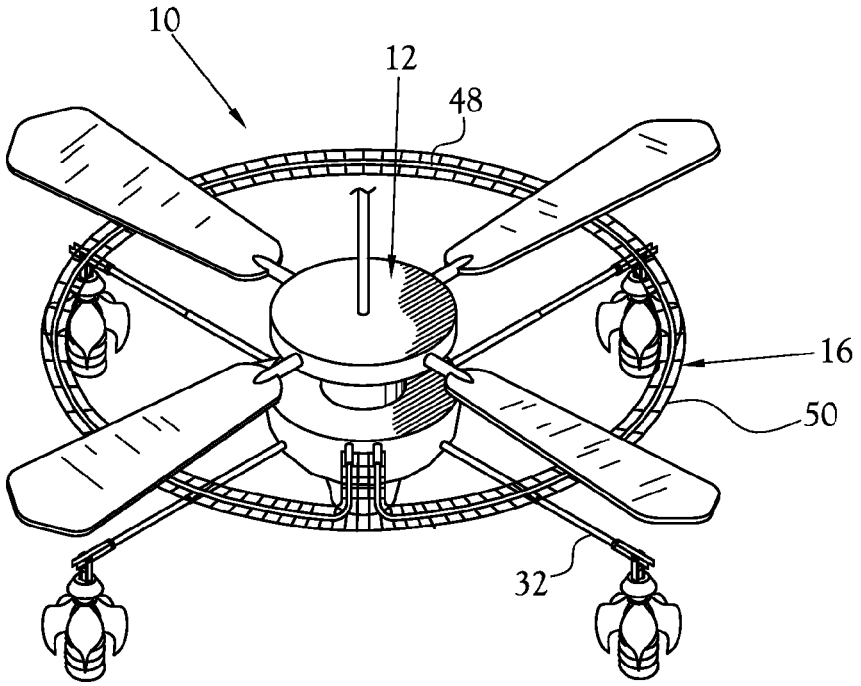
FIG. 4A is a perspective view of one embodiment of the present invention wherein the heating assembly is repositioned above the lighting assembly.
Figure 4B:
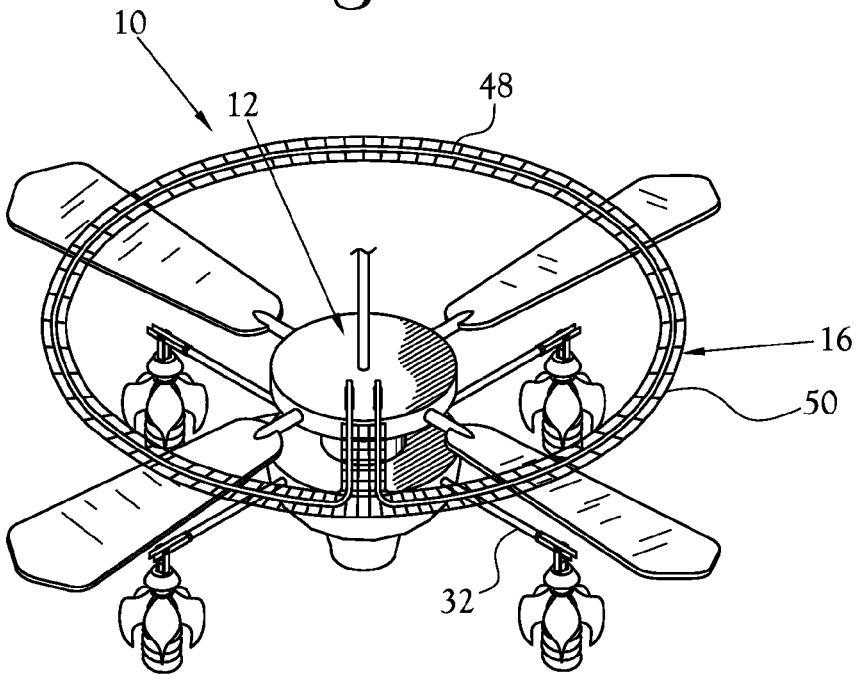
FIG. 4B is a perspective view of one embodiment of the present invention wherein the heating assembly is repositioned above the ceiling fan.

FIGS. 4A and 4B show alternate embodiments of the lighting and heating assembly for a ceiling fan 10 having an adjustable heating assembly 16, which allows the heating element 48 and heating element cage 50 to be repositioned relative to the air flow generated by the ceiling fan 12. It will be appreciated that the adjustable arrangements of the heating assembly 16 allow a user to selectively control the manner of lighting and heating for an environment. For example, the lighting arms 32 extend outward two lengths of tubing in FIG. 4A, but only one length of tubing in FIG. 4B.

In the embodiment illustrated in FIG. 4A, the heating assembly 16 is configured to provide sufficient heating for a selected area of the environment, which is essentially the area below the ceiling fan 12, while providing insufficient heating for the entire environment. More specifically, air directed downwards comes in contact with the heating element 48 such that the downward air flow is heated and thereby heating the isolated area below the heating assembly 16. For example, in a large environment, warm air near the top of the environment is directed downward into communication with the heating element, whereby the air is heated and directed into the localized area below the heating element such that a first person standing below the heating assembly 16 experiences a warmer temperature than a person standing away from the heating assembly 16. In this arrangement, the heating assembly 16 provides heat to an occupied area of an environment while eliminating the need to heat the entire environment.

Alternatively, in the embodiment illustrated in FIG. 4B, the heating assembly 16 is positioned above the ceiling fan 12 and the lighting assembly 14 such that the heating element 48 is positioned in communication with upward air flow produced by the ceiling fan 12. More specifically, air directed upwards comes in contact with the heating element 48 such that the air is heated and thereafter directed towards the perimeter of the environment and circulated within the environment. For example, in an environment such as a room, cool air in the environment is slowly directed upwards into communication with the heating element 48 such that the air is heated and directed towards the perimeter the environment and thereafter circulated into the environment. In this arrangement, the heating assembly 16 is responsible for providing heated air throughout the entire environment, such as a single room in a house, without requiring the heating of air in other environments, such as other rooms within a house. Accordingly, it is recognized that the adjustable arrangements of the heating assembly 16 allow a user to selectively control whether to provide heat for a small portion of an environment or the entire environment without heating neighboring environments thereby providing energy efficient heating for the user.

Figure 5A:
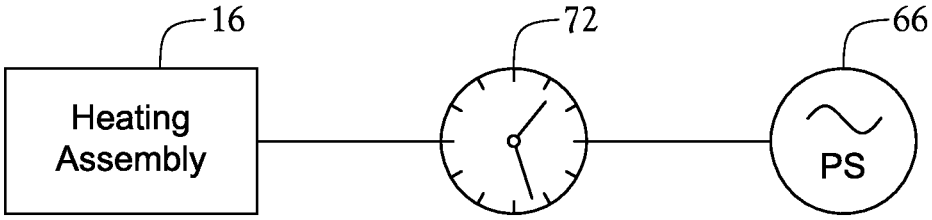
FIG. 5A illustrates a diagram of the power supply and a timer as represented by one embodiment of the present invention.
Figure 5B:
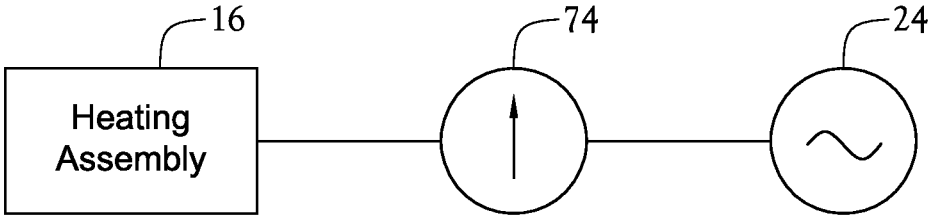
FIG. 5B illustrates a diagram of the power supply and a rheostat as represented by one embodiment of the present invention.
Figure 5C:
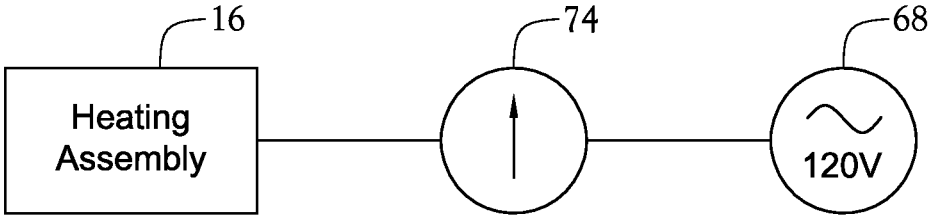
FIG. 5C illustrates a diagram of the power supply and a rheostat as represented by one embodiment of the present invention.
Figure 5D:
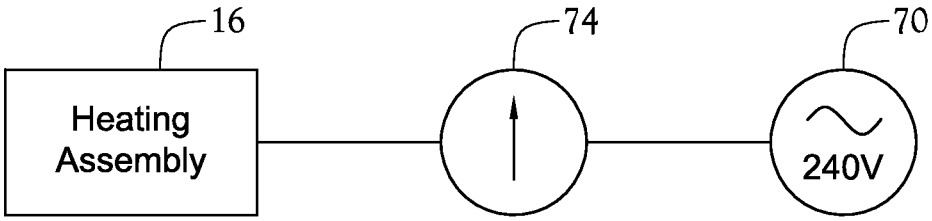
FIG. 5D illustrates a diagram of the power supply and a rheostat as represented by one embodiment of the present invention.
Figure 5E:
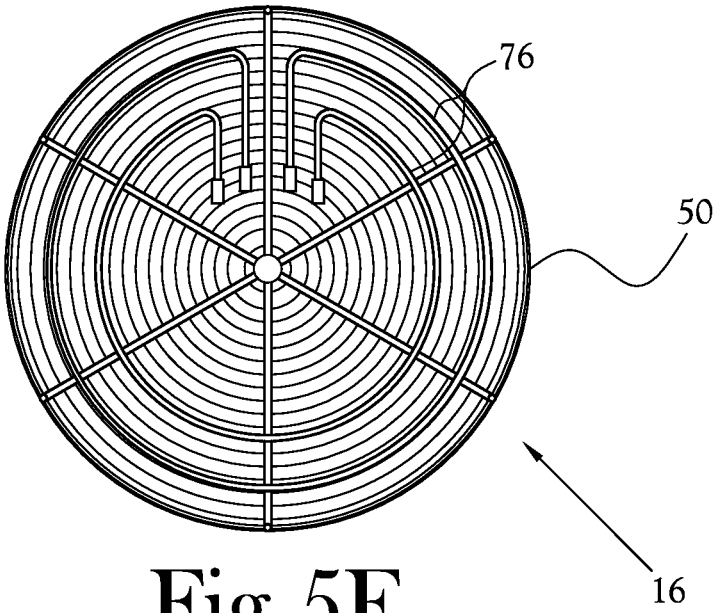
FIG. 5E is a perspective view of one embodiment of the heating element.
Figure 5F:
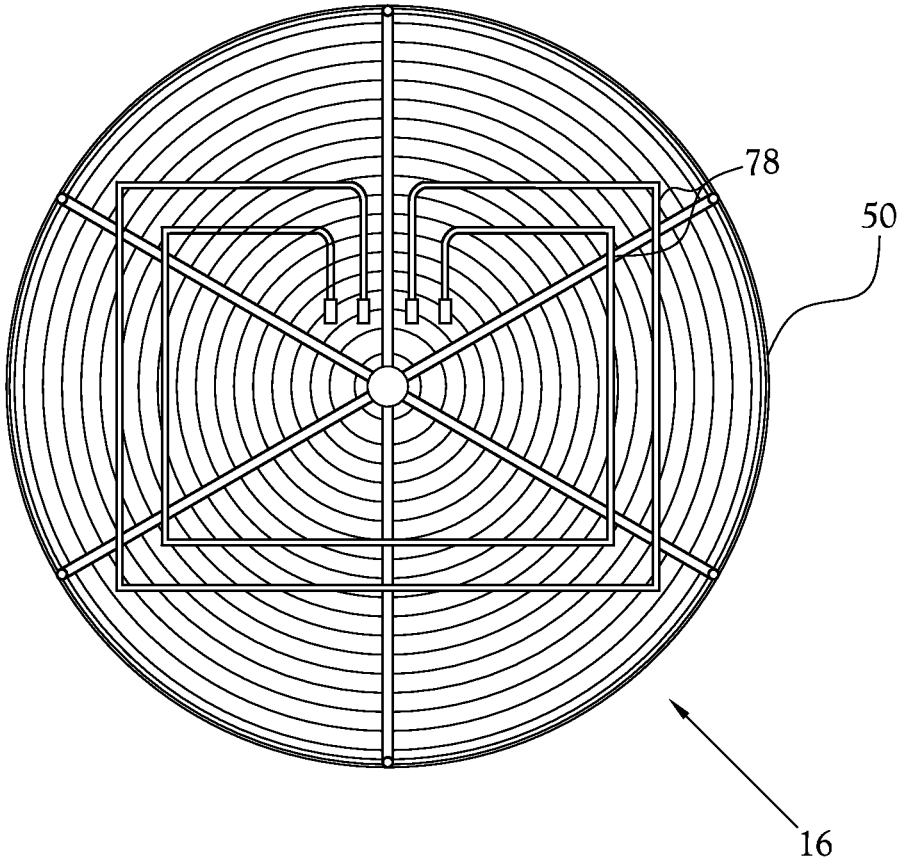
FIG. 5F is a perspective view of one embodiment of the heating element.

FIGS. 5A-5G illustrate diagrams wherein the heating element is configured to provide variable levels of heating for the environment. Variable levels of heating for the environment are determinable by user controls, altering the surface area of the heating element, arrangement of the heating element, or the like. For example, as illustrated in FIGS. 5A-D, power may be provided by any power source 66 (FIG. 5A), the electrical connection 24 (FIG. 5B) provided by the ceiling fan 12, an independent 120 volt power supply 68 (FIG. 5C), or an independent 240 volt power supply 70 (FIG. 5D). Furthermore, as depicted in FIG. 5A, the controls for the heating assembly 16 include a time control 72 to automatically turn on or off the heating assembly 16. Alternatively, as illustrated by FIGS. 5B-D, placing a rheostat 74 further allows a user to adjust the power supplied to the heating assembly 16 to increase or decrease the temperature at which the heating assembly 16 operates. Inclusion of any of the above controls further increase the energy efficiency of the heating assembly 16 and decreased the cost and saves money for heating an area.

Figure 5G:
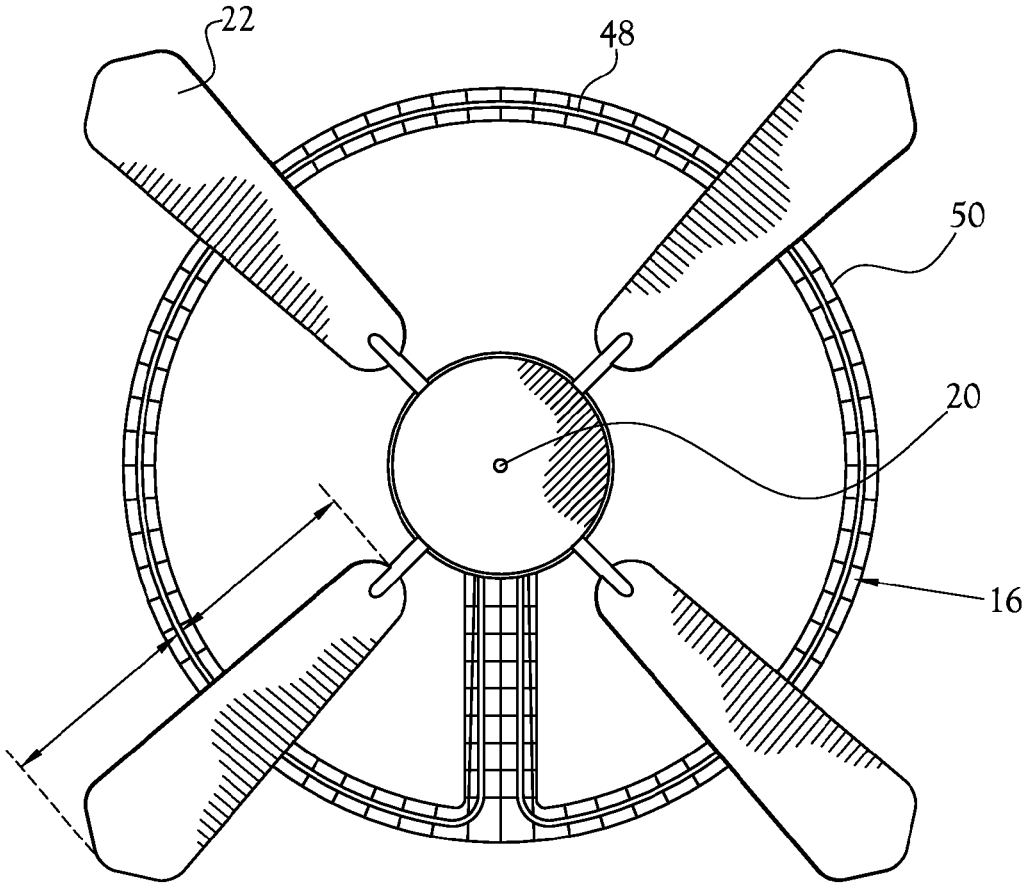
FIG. 5G is a plan view of one embodiment of the ceiling fan and the lighting and heating assembly of the present invention, showing the area in the plane which the heating assembly may occupy.

Alternatively, the heating characteristics of the heating assembly 16 are adjustable by varying the shape and number of the heating element 48. For example, the surface area of the heating element 48 is increased by including a series of concentric circles 76 each having a smaller radius than the previous, or a series of rectangles 78 in which each rectangle has a smaller rectangle within the interior. Lastly, the exposure of the heating element 48 is maximized by positioning the heating element 48 to extend outwardly from the vertical axis 20 a distance of about half the length of the individual lengths of the fan blades 18. As illustrated in FIG. 5G, the heating element 48 is positioned around the vertical axis 20 at distances between the inside edge and outside edge of the fan blades 18 such that the position of the heating element 48 is in the direct air flow generated by ceiling fan 12.

Figure 6:
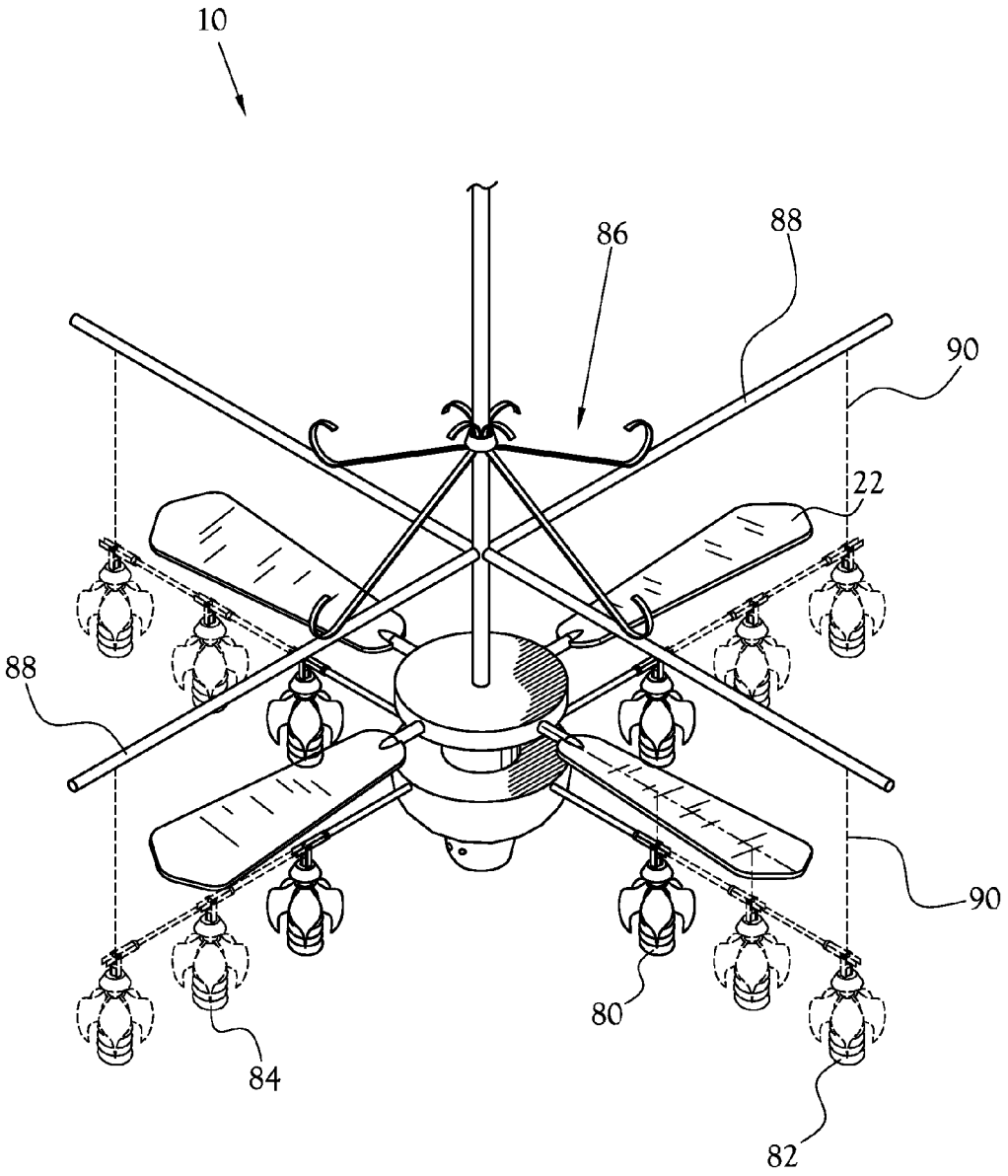
FIG. 6 is a perspective view of one embodiment of the present invention including telescoping lighting arms and showing the available support provided by the upper support.

FIG. 6 illustrates a ceiling having one embodiment of the lighting and heating assembly 10 secured thereto is provided. As depicted, the lighting and heating assembly 10 has the heating assembly 16 detached from the lighting assembly 14 such that the ceiling fan 12 only supports the lighting assembly 14. This functionality allows a user to selectively utilize the lighting and heating assembly 10 such that the user enjoys the benefits of the lighting assembly 14 without the heating assembly 16. In the embodiment illustrated in FIG. 6, the lighting assembly 14 includes telescoping lighting arms 36 configured to extend the socket 40 between a first location 80 and a second location 82, namely a location proximate the housing 30 and position remote from the housing 30, respectively. In the first position 80 the lighting arms 36 support the light bulbs 46 in a relatively small radius about the vertical line 20 such that lighting is generally directed to the area below lighting and heating assembly 10. This arrangement provides a greater concentration of light for performing activities, such as reading. Moreover, in the first position 80, the lighting assembly 14 positions the light bulbs 46 at a position of direct air flow generated by ceiling fan 12 between the inside edge and outside edge of the fan blades 18. Additionally, this placement is ideal for ionizers, such as anion bulbs, for maximum exposure of air flow generated by the ceiling fan 12 and thereby providing the maximum amount of purification. In the second position 82, the lighting arms 36 support the light bulbs at a larger radius from the vertical line 20 such that lighting is directed into a larger portion of the environment, or even the entire environment, thereby reducing the necessity of using additional lighting throughout the environment. Alternatively, the user can position the lighting arms 36 between the first position 80 and second position 82, such as the interim position 84, which provides lighting as desired.

In one embodiment, the lighting and heating assembly 10 includes additional support for reducing deflection of the lighting arms 32 when fully extended. For example, in FIG. 6, the lighting and heating assembly 10 includes an upper support 86. The upper support 86 is attached to the tubing 14 for the ceiling fan 12 and includes members 88 that extend outward from the tubing 14 to a position in register with the lighting arms 36. More specifically, the distal end of a lighting arm 36 is connected to a distal end of members 88 of the upper support 86 by a readily attachable and detachable cable 90, which allows the upper support 86 to be selectively utilized in supporting the lighting assembly 14. In alternate embodiments, the members 88 are securable to the ceiling by the cable 90.

Figure 7:
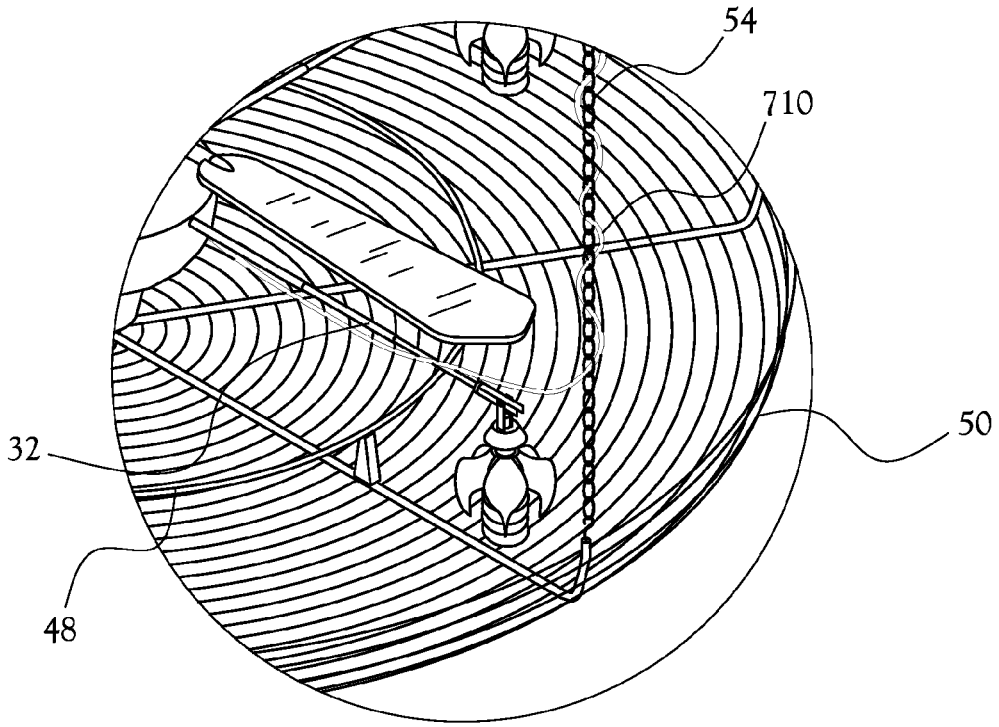
FIG. 7 illustrates an example of a separate power source provided to the heating element according to an embodiment of the present general inventive concept.

As previously described in regard to FIGS. 5A-5D, the heating element of the heating assembly 16 may be powered by a source other than the electrical connection provided by the ceiling fan. For example, in certain applications, such as industrial settings, it may be desirable for the heating element to be sized and/or configured to draw a different or larger amount of power than that which is powering the ceiling fan and/or lighting assembly. According to various example embodiments, this different power source may be provided through the ceiling fan, or may be wired directly to the heating element without being routed through the ceiling fan. FIG. 7 illustrates an example of a separate power source provided to the heating element according to an embodiment of the present general inventive concept. In FIG. 7, an external power connection 710 is provided by wiring that extends from above, or outside, the ceiling fan 12 and runs along the chain 54 which suspends the heating element cage 50. In the example emobidment illustrated in FIG. 7, the wiring is configured to lead away from the chain 54 and run along the lighting arm 32 into the housing 30 to connect to the first and second heating terminals 52A and 52B of the heating element 48. In other example embodiments, the wiring may continue along the structure of the heating element cage 50 to the first and second heating terminals 52A and 52B of the heating element 48. In such embodiments, the external power connection 710 may be coupled to the heating element cage 50 to prevent contact with the heating element 48 in areas in which the external power connection 710 is in close proximity with the heating element 48. Further, the external power connection 710 may be provided with thermal shielding to prevent heat damage from the heating element 48. The external power connection 710 may be wired to the same or a different voltage than that provided to the ceiling fan 12. In various example embodiments, the external power connection may be, for example, a 120V residential connection. In various other example embodiments, the external power connection may be, for example, a 240V commercial or industrial application.

Figure 8:
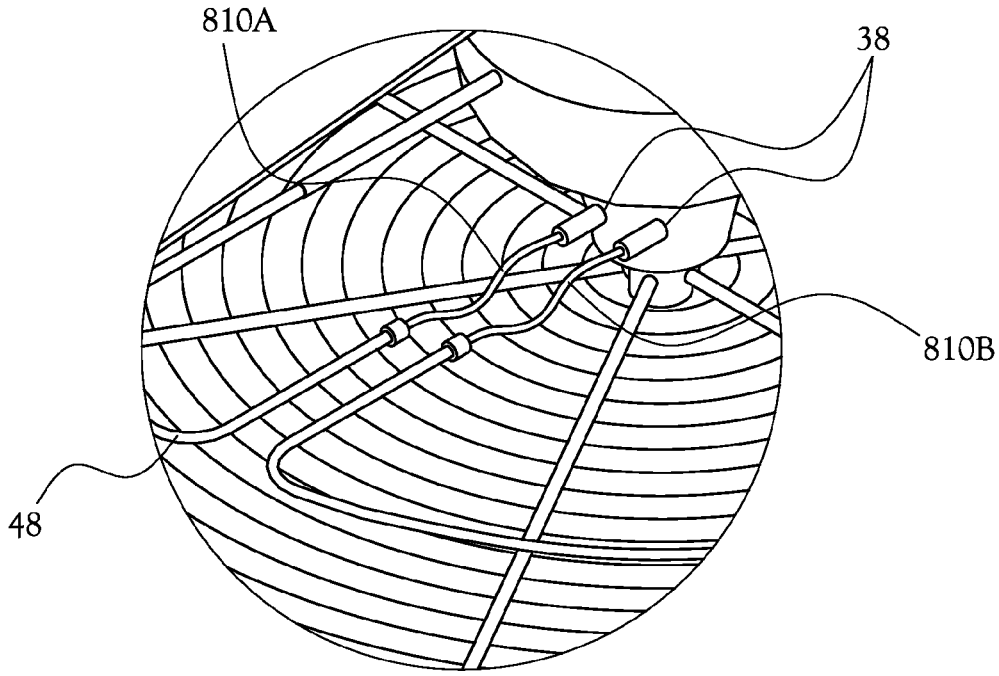
FIG. 8 illustrates another example embodiment of the first and second heating terminals of the heating element according to the present general inventive concept.

FIG. 8 illustrates another example embodiment of the first and second heating terminals of the heating element according to the present general inventive concept. In FIGS. 1-2, the first and second heating terminals 52A and 52B are illustrated as being directly connected to the rigid heating element 48, and therefore may provide structural support when the heating element 48 is connected to the lighting assembly 14 by sliding the first and second heating terminals 52A and 52B into the auxiliary connection 38 of the housing 30 of the lighting assembly 14. In the example embodiment illustrated in FIG. 8, flexible first and second heating terminals 810A and 810B are provided such that the heating element 48 may be selectively connected to either the auxiliary connection 38 of the housing 30 of the lighting assembly 14, or to the external power connection 710 provided along the chain 54 supporting the heating element cage 50. The flexible first and second heating terminals 810A and 810B may also be selectively connected to a power source provided by other than these two described sources, as the flexibility of the first and second heating terminals 810A and 810B allow the selective use of different power sources without having to significantly change the configuration of the heating element 48 and heating element cage 50. Additionally, due to the flexibility of the first and second heating terminals 810A and 810B, the height of the heating element 48 and heating element cage 50 may be adjusted to be higher or lower in relation the ceiling fan 12, and yet still be able to maintain the readily attachable and detachable connection with the auxiliary connection 38 of the housing 30 of the lighting assembly 14. For example, such an adjustment may simply involve adjusting the length of the chain 54 which suspends the heating element cage 50, such as by using a different loop of the chain at a suspension point at the ceiling, and the heating element 48 may still be attachable to the auxiliary connection 38, without being provided horizontally to the auxiliary connection 38, due to the flexibility of the flexibly first and second heating terminals 810A and 810B.

Figure 9:
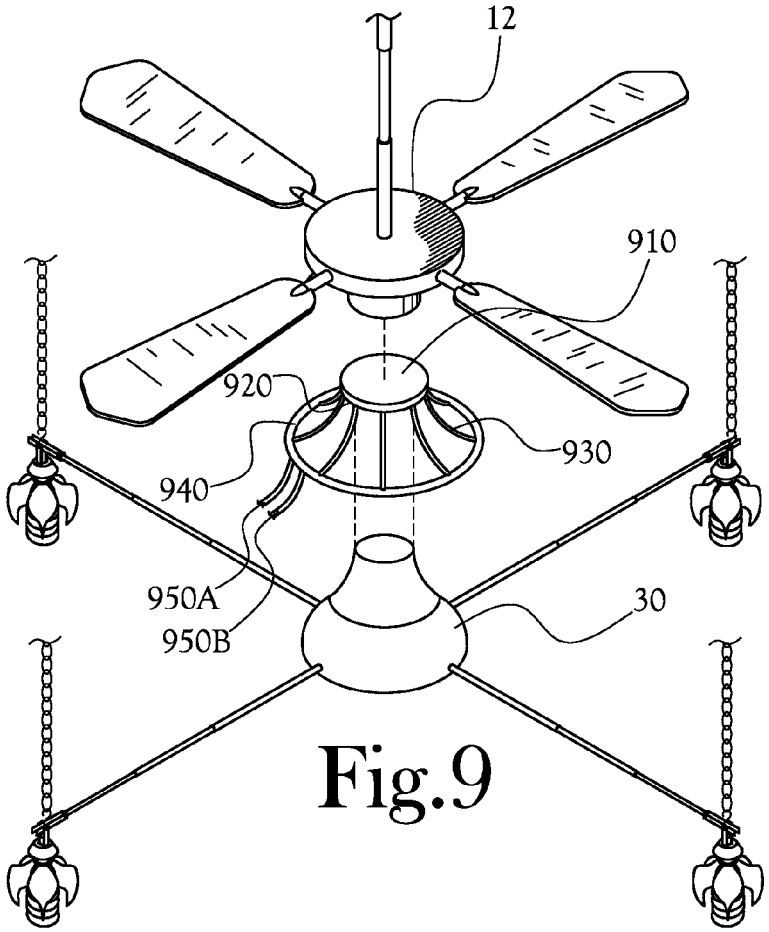
FIGS. 9-10 illustrate another example embodiment of a heating assembly according an embodiment of the present general inventive concept.
Figure 10:
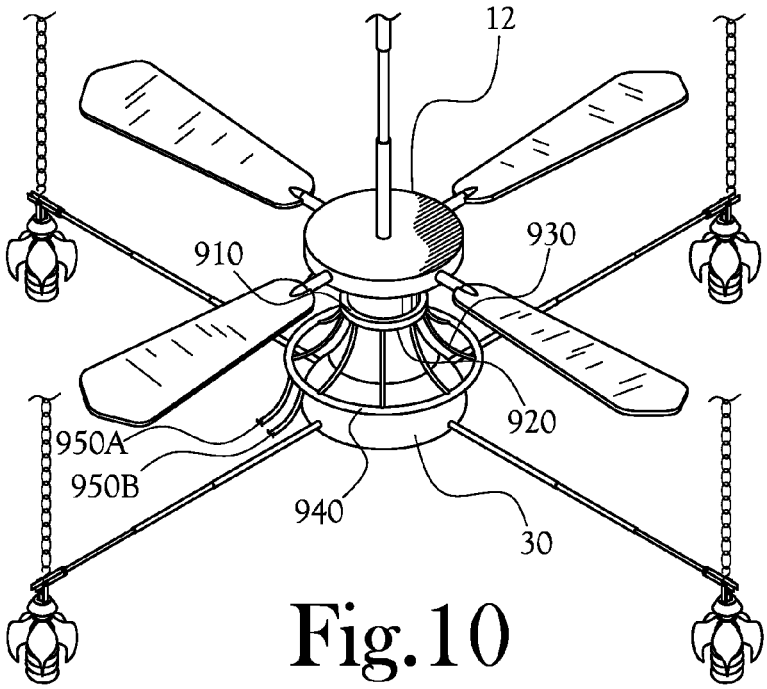

FIGS. 9-10 illustrate another example embodiment of a heating assembly according an embodiment of the present general inventive concept. In FIGS. 9-10, a top-mounted heating assembly 910 is coupled to the top of the housing 30 of the lighting assembly 14. The top-mounted heating assembly 910 includes a base 920 which may be directly coupled to the housing 30 of the lighting assembly 14 by, for example, a bolt that extends through the housing 30 and the base 920. Heating element supports 930 extend downward and outward from the base 920 so as to support a heating element 940 that will be configured around the housing 30 and under the blades of the ceiling fan 12. Flexible first and second heating terminals 950A and 950B may be provided to connect the heating element 940 to the auxiliary connection 38 of the housing 30 of the lighting assembly 14, or to a separate power connection. Although the flexible first and second heating terminals 950A and 950B are illustrated as extending from the outer perimeter of the heating element 940, it is understood that the power supply could be connected at other points, such as the base 920 of the heating assembly 910. The configuration of the top-mounted heating assembly 910 allows the structural support of the heating assembly 910 to be provided by the housing 30 of the lighting assembly 14. FIG. 9 illustrates an exploded view of the top-mounted heating assembly 910 and the lighting assembly 14, and FIG. 10 illustrates the top-mounted heating assembly 910 coupled to the lighting assembly 14. In other various example embodiments, the heating assembly 910 and housing 30 may be inverted to allow the heating assembly 910 to be configured as a bottom-mounted heating assembly. As with other various example embodiments described herein, such a configuration would allow the heating assembly 910 to be readily detachable and re-attachable to the lighting assembly, and the structural and electrical connection may be detached and re-attached without interrupting operation of the lighting assembly 14 and/or the ceiling fan 12. FIG. 10 also illustrates support chains 960 which may be included to support the lighting arms 32 when the lighting arms are extended beyond the length of the ceiling fan blades.

Figure 11:
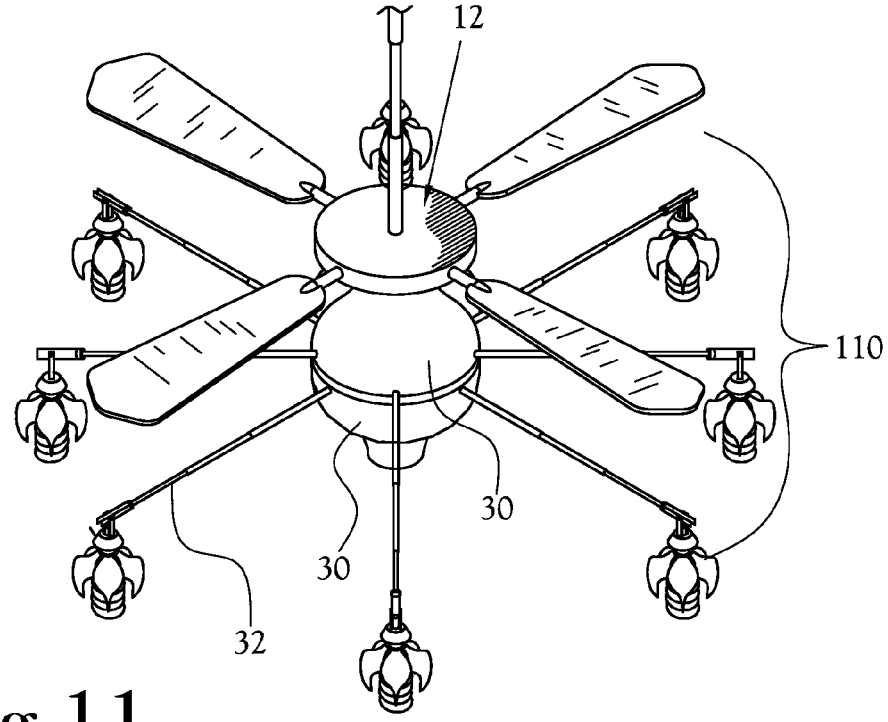
FIG. 11 illustrates another example embodiment of a lighting assembly according to the present general inventive concept.

FIG. 11 illustrates another example embodiment of a lighting assembly according to the present general inventive concept. As illustrated in FIGS. 2 and 6, the bell-shaped housing 30 of the lighting assembly 14 supports telescoping lighting arms 32. Various example embodiments of the housing 30 may have openings at the small and large ends of the bell shape. The opening at the larger end of the housing 30 is typically used to receive the power connections and physical couplings of the ceiling fan 12, while an opening may be provided at the smaller end of the housing 30 to accommodate, for example a bolt to attach a bottom-mounted housing, or a suspension mechanism for suspending a lantern or other type lighting fixture. As illustrated in FIG. 11, the housing 30 and lighting arms 32 of two such lighting assemblies may be combined to form one lighting assembly 1110 which accommodates 8 telescoping lighting arms. Such an assembly may be formed by simply inverting the bell-shaped housing 30 and coupling the inverted housing 30 to another housing 30. As each housing 30 may provide the auxiliary connection 38, a heating element of a detachable and re-attachable heating assembly may still be selectively connected to the lighting assembly 1110.

Figure 12:
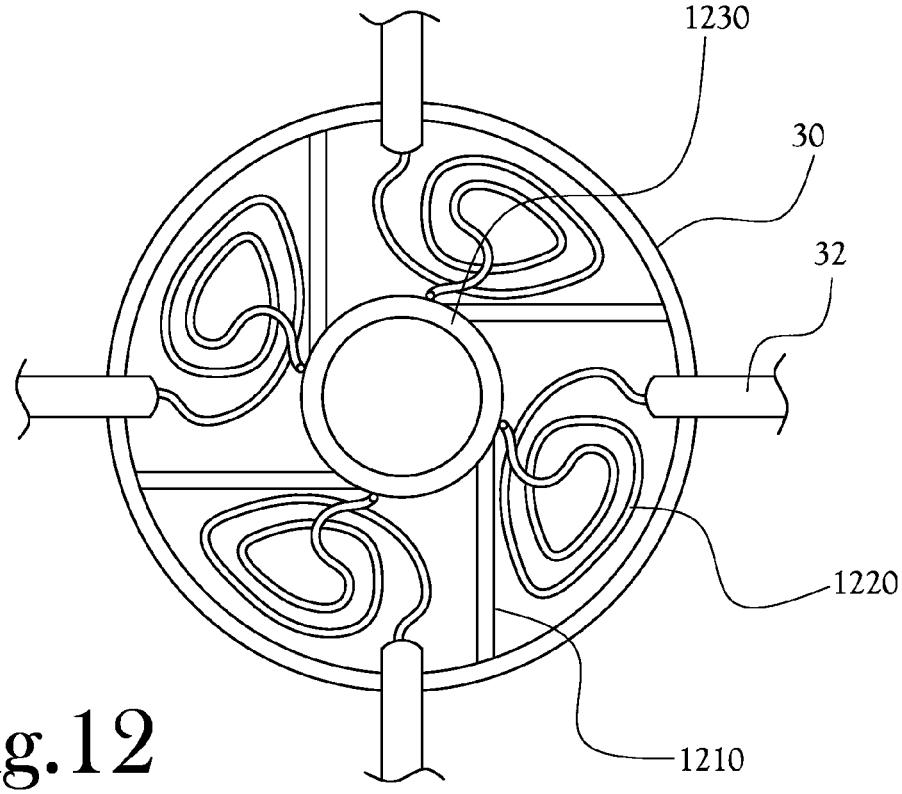
FIG. 12 illustrates a top view cross section of a lighting assembly housing according to an embodiment of the present general inventive concept.

FIG. 12 illustrates a top view cross section of a lighting assembly housing according to an embodiment of the present general inventive concept. As illustrated in FIG. 12, partitions 1210 may be provided inside the housing 30 of the lighting assembly 14 to separate the respective wirings 1220 provided to the telescoping lighting arms 32 such that the wirings 1220 do not become entangled with one another. As much of the wirings 1220 are contained within the housing 30 when the telescoping lighting arms 32 are fully retracted, there is a higher chance of the wirings 1220 interacting to form knotting and other similar problems which might prevent the full extension of the telescoping lighting arms 32, and at least some of such interaction is prevented by the partitions 1210. Such partitioning will also aid in preventing entanglements with the wiring providing power to the auxiliary connection 38, which is not illustrated in this drawing. The partitions 1210 may be coupled to a partition anchor 1230 which maintains the position of the partitions 1210. The partition anchor 1230 may be provided around a support rod that extends through the housing 30 of the lighting assembly 14. In other various example embodiments, the partitions may be formed integrally with the housing 30.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A lighting assembly for a ceiling fan, the ceiling fan having an attachment interface having an electrical connection for powering an external assembly, the lighting assembly comprising:

a housing configured to be connected to and supported by the attachment interface of the ceiling fan and to receive the electrical connection of the ceiling fan;

a plurality of lighting arms extending from the housing and provided with a socket to receive a light bulb, the socket being configured to be in electrical communication with the electrical connection of the ceiling fan; and an auxiliary connection formed in a side of the housing to provide power to a modular external device that may be selectively coupled to the housing.

2. The lighting assembly of claim 1, wherein the auxiliary connection is selectively connected to the electrical connection of the ceiling fan or a separate power source provided through the housing.

3. The lighting assembly of claim 1, further comprising a heating assembly that is readily attachable and detachable to the auxiliary connection of the lighting assembly, wherein the structure and operation of the lighting assembly is maintained during the attachment and/or detachment of the heating assembly.

4. The lighting assembly of claim 3, wherein the heating assembly comprises a heating element having at least one heating terminal that is selectively connected to the auxiliary connection of the lighting assembly.

5. The lighting assembly of claim 4, wherein the heating element is provided around a portion of the lighting assembly.

6. The lighting assembly of claim 4, wherein the at least one heating terminal includes a flexible portion extending from the heating element.

7. The lighting assembly of claim 4, wherein the heating assembly further comprises a heating element cage configured to be suspended from a structural point other than the housing of the lighting assembly to support the heating element.

8. The lighting assembly of claim 7, further comprising an external power connection provided along a suspension portion of the heating element cage and at least one of the lighting arms, wherein the heating element is selectively connected to the external power connection or the auxiliary connection of the housing.

9. The lighting assembly of claim 7, further comprising an external power connection provided along a suspension portion of the heating element cage and at least one of the lighting arms to provide power to the auxiliary connection of the housing.

10. The lighting assembly of claim 9, wherein the external power connection is provided inside the at least one lighting arm.

11. The lighting assembly of claim 7, wherein the height of the heating assembly is adjustable to move the heating element closer to or further from ceiling fan.

12. The lighting assembly of claim 3, wherein the heating assembly comprises a base that is configured to be coupled to a top portion of the housing, one or more support members extending downward and outward from the base, a heating element supported by the support members such that the heating element is provided around a portion of the housing and under blades of the ceiling fan, and a flexible heating terminal to connect to the auxiliary connection of the housing.

13. The lighting assembly of claim 1, wherein the plurality of lighting arms are configured to be selectively extended from and retracted to various distances from the housing.

14. The lighting assembly of claim 13, further comprising partitioning members provided inside the housing to prevent respective wirings of the lighting arms from contacting one another.

15. The lighting assembly of claim 1, wherein the housing is approximately bell shaped, and the broader end of the housing is coupled to the ceiling fan.

16. The lighting assembly of claim 15, further comprising an additional housing of substantially the same shape inverted and coupled between the housing and ceiling fan.

17. The lighting assembly of claim 16, wherein the additional housing accommodates an additional plurality of lighting arms.

* * * * *